United States Patent [19]

Carboni

[11] Patent Number: 4,480,294

[45] Date of Patent: Oct. 30, 1984

[54] LAMP THAT CAN BE THROWN

[76] Inventor: Alberto Carboni, Via Fronticelli, 21 - Forli' , Italy

[21] Appl. No.: 447,122

[22] Filed: Dec. 6, 1982

[30] Foreign Application Priority Data

Sep. 20, 1982 [IT] Italy ..... 14741/82[U]

[51] Int. Cl.[3] ..... F21L 7/00; F21L 9/00

[52] U.S. Cl. ..... 362/184; 362/186; 362/189; 362/200; 362/251; 362/295; 362/307; 362/310; 362/311; 362/355; 362/360; 362/375; 362/376; 362/390

[58] Field of Search ..... 362/186, 806, 189, 96, 362/102, 200, 310, 311, 318, 320, 251, 352, 355, 367, 184, 295, 307, 360, 375, 376, 390

[56] References Cited

U.S. PATENT DOCUMENTS

| | | | |
|---|---|---|---|
| 2,383,390 | 8/1945 | Jacobs | 362/806 |
| 2,879,381 | 3/1959 | Coffey | 362/189 |
| 3,011,048 | 11/1961 | O'Brien | 362/208 |
| 3,128,951 | 4/1964 | Nicholl | 362/186 |
| 3,323,117 | 5/1967 | Mason | 362/158 |
| 3,458,205 | 7/1969 | Smith et al. | 362/208 |
| 3,580,575 | 5/1971 | Speeth | 362/253 |
| 3,596,078 | 7/1971 | Owens | 362/186 |
| 4,124,881 | 11/1978 | Haber et al. | 362/806 |
| 4,158,880 | 6/1979 | McJunkin, Jr. | 362/367 |
| 4,292,999 | 10/1981 | Szollman | 362/96 |

*Primary Examiner*—Stephen J. Lechert, Jr.
*Assistant Examiner*—Howard J. Locker
*Attorney, Agent, or Firm*—Darby & Darby

[57] ABSTRACT

A lamp can be thrown alight from a distance by the person using it. The lamp comprises a polyhedral casing, made of shockproof material, inside which is housed a source of light that emits pluridirectional beams.

4 Claims, 2 Drawing Figures

LAMP THAT CAN BE THROWN

BACKGROUND OF THE INVENTION

The invention relates to a lamp utilizable principally, though not exclusively, by law enforcement bodies, which can be thrown alight from a distance.

In particular, the lamp can be best used at the time members of the administrations concerned in the preservation and enforcement of public order are conducting actions of irruption into dark and unforseeable areas where ill disposed or dangerous persons lurk. It is, in fact, necessary, in such circumstances, to illuminate the surroundings and this frequently leads to consequences drastic for the members of the law enforcement bodies who are physically exposed to the malefic intentions of individuals who live by crime.

When bursting in, the time it takes to look for and find the electric lighting switch represents a period that is notably dangerous for the law enforcement officers, in cases when an electric torch is not used; the latter, however, increases the risk factor since it exposes the law enforcement officer to being an easy target for whoever is in the inside of the area of suspect.

DESCRIPTION OF THE PRIOR ART

Nothing of an equivalent nature to the invention described herein is known to exist as regards prior art.

SUMMARY OF THE INVENTION

The main object of the invention, through which the aforementioned difficulties are overcome, is to construct a novel lamp that can be thrown by the operator into areas that are in the dark, with the rapidity the circumstance requires, so that the said area be illuminated completely in a number of directions, with the lamp remaining alight and intact for future use.

Another important object of the invention is to construct a lamp whose light source function is in no way jeopardized, even after having been thrown a number of times and after having been subjected to a number of impacts, since it is composed prevalently or totally of shockproof material, such as, for example, a rubbery material.

The last but by no means least object of the invention is to construct a lamp that can be thrown with adequate precision and that, once it has been thrown, quickly comes to rest in a stable position, the casing being preferably polyhedral, for example in the form of a cube.

It thus ensues from the foregoing that in addition to the indisputable element of surprise, the law enforcement officers are able to immediately view the area that was previously in the dark, with all this contributing in notably increasing the probability of the operation having a successful outcome. In fact, the person who utilizes a lamp according to the invention is not exposed to any risk and remains completely free to move.

BRIEF DESCRIPTION OF THE DRAWING

Further characteristics and advantages of the invention will become more apparent from the description that follows, illustrated purely as an unlimited example on the one accompanying drawing, in which.

DESCRIPTION OF THE PREFERRED EMBODIMENT

Figure 1:
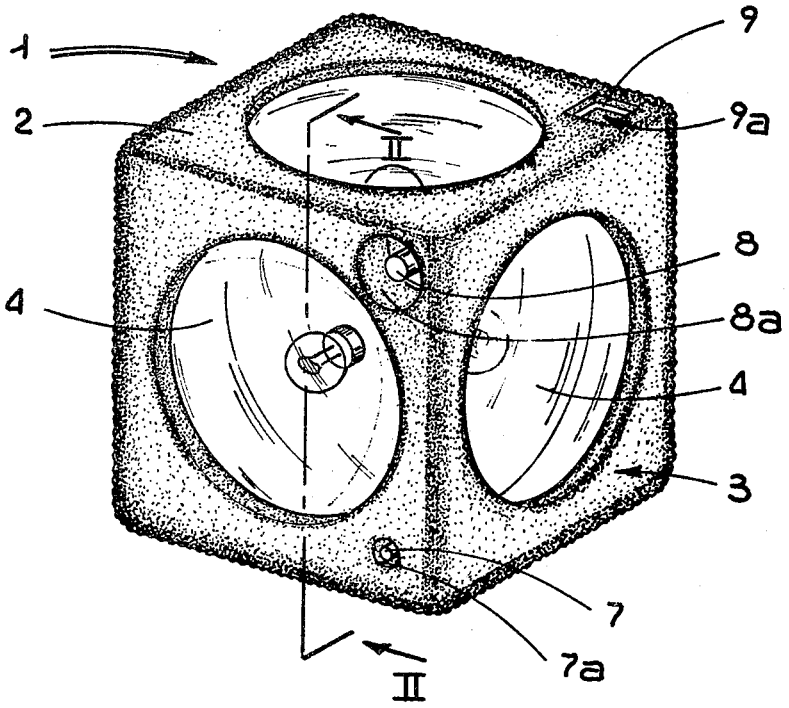
FIG. 1 shows, in a perspective view, the lamp forming the subject of the invention.
Figure 2:
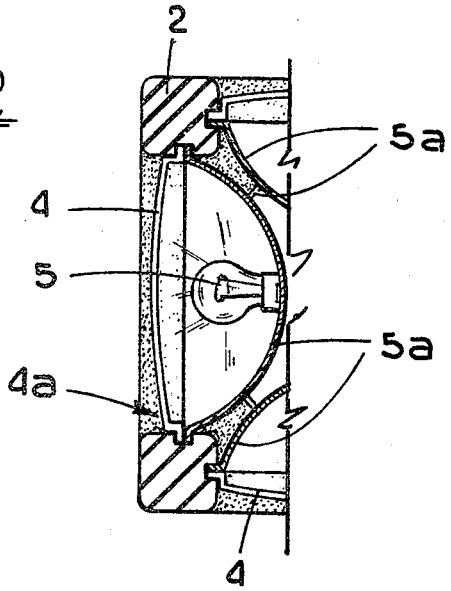
FIG. 2 shows a partial section of the lamp along the line II--II in FIG. 1.

With reference to the above listed figures, in one preferred embodiment the lamp in question is formed by a cube shaped casing 2 whose major part is composed of soft rubber in such a way as to deaden the fall and brake rolling motion subsequent thereto.

Centrally all the sides 3 of the lamp 1 are provided with screens 4 of transparent material, through which is radiated a strong light coming from one or more sources of light located in the inside of the casing 2.

In the embodiment described herein, each side 3 is provided with a lamp 5 placed on its own parabolic reflector 5*a*, supplied by a battery (not illustrated on the accompanying drawing since an explanation of the concepts of the invention does not require other than a mention), which can be recharged by inserting the plug 7 provided into a mains connected socket.

The light can also be produced by one single lamp 5—of a suitable voltage—fixed at the center of the structure, with a light that can be focused, through means known to technicians in the field concerned, in the region of the screens 4 in the casing 2.

To one side of the cube is fitted a switch 8 which, in the described embodiment, is the one and only switch for all the lamps in the contrivance and, depressed at the time the lamp is thrown, causes light to radiate in all directions. It is obvious that at least the switch 8, the plug 7 and the screens 4, are placed in indentations or recesses numbered 8*a*, 7*a* and 4*a*, respectively, formed in the casing 2 for the purpose of preventing the lamp 1 suffering any damage after it has been thrown.

There are no set dimensions for the lamp according to the invention, though they must not be such as to hinder or be excessively voluminous for the movements of the operator. To enable the lamp to be carried more easily, it is provided with a supporting hook 9, this too inserted in a recess 9*a*.

The way in which the lamp 1 is constructed allows easy access for the eventual replacement of each and every component part. As regards the parts inside the lamp 1, details have not been given herein of the way in which they are disposed since a description is not pertinent to the concepts of the invention and, in any case, the arrangement of the component parts inside the lamp 1 can easily be established by the average technician.

What is claimed is:

1. A lamp that can be thrown, comprising a casing having a plurality of sides assembled in the shape of a polyhedron, made of shockproof material, one of said sides being formed with an indentation, a plurality of transparent screens respectively mounted in said sides in recessed relation thereto, at least one source of light mounted firmly in the inside of the casing switch means mounted in said indentation for actuating said source of light, said source of light, when actuated, radiating through each of said screens, and said lamp, when thrown with said switch so actuated, providing illumination of the surroundings simultaneously in a plurality of directions through said screens.

2. A lamp according to claim 1 in which the source of light is constituted by a lamp for each screen in the polyhedral casing, further comprising a corresponding parabolic reflector for each lamp and at least one battery for supplying electricity to the lamps.

3. A lamp according to claim 1 in which the source of light is constituted by one single lamp and a corresponding battery for supplying electricity, the light being focused in the region of the screens in the polyhedral casing.

4. A lamp according to claim 1 in which said polyhedral casing is in the shape of a cube.

* * * * *